United States Patent [19]

Gilbert

[11] Patent Number: 4,689,903

[45] Date of Patent: Sep. 1, 1987

[54] EARTH DIGGING MACHINE FOR USE ON SOFT OR UNDULATING TERRAIN, PARTICULARLY FOR THE CLEARING OF PONDS, SWAMPS OR CANALS

[76] Inventor: Bibaut Gilbert, 22, rue de Compiègne, 60880 Le Meux, France

[21] Appl. No.: 770,588

[22] Filed: Aug. 29, 1985

[30] Foreign Application Priority Data

Sep. 3, 1984 [FR] France ..... 84 13585

[51] Int. Cl.[4] ..... E02F 5/02

[52] U.S. Cl. ..... 37/103; 280/7.12; 280/28.5; 280/638

[58] Field of Search ..... 37/103, 117.5; 280/5.24, 7.12, 9–11, 28.5, 638

[56] References Cited

U.S. PATENT DOCUMENTS

| | | | |
|---|---|---|---|
| 2,653,795 | 9/1953 | Reeves | 37/103 X |
| 3,072,272 | 1/1963 | Howlett | 37/103 |
| 3,344,539 | 10/1967 | Crum | 37/103 |
| 3,589,538 | 6/1971 | Menzi | 37/103 |
| 3,606,047 | 9/1971 | Schaeff | 37/103 |
| 3,635,364 | 1/1972 | Tingleff | 37/103 |
| 4,049,070 | 9/1977 | Soyland | 37/103 |

FOREIGN PATENT DOCUMENTS

| | | | |
|---|---|---|---|
| 2411115 | 9/1974 | Fed. Rep. of Germany | 37/71 |
| 605450 | 5/1960 | Italy | 37/260 |
| 436146 | 11/1967 | Switzerland | 37/103 |
| 848277 | 9/1960 | United Kingdom | 37/103 |
| 920423 | 3/1963 | United Kingdom | 37/103 |
| 492632 | 2/1976 | U.S.S.R. | 37/103 |

*Primary Examiner*—E. H. Eickholt

*Attorney, Agent, or Firm*—Morris Fidelman; Franklin Wolffe

[57] ABSTRACT

A soft terrain earth digging machine, especially for the clearing and dredging of ponds, swamps or canals, of a type consisting of a bearing structure fitted with a central and lateral stabilizers and equipped with at least one earth digging device such as shovel, this device being controlled from a pilot cabin mounted on the bearing structure, wherein the central stabilizer is secured to a control carriage moving between two side rails of bearing structure, at least two support devices such as wheels or walking legs being mounted on telescopic arms ensuring the displacement control of these devices.

11 Claims, 27 Drawing Figures

FIG. 15
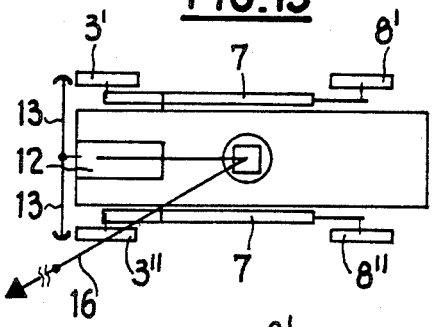
FIG. 16
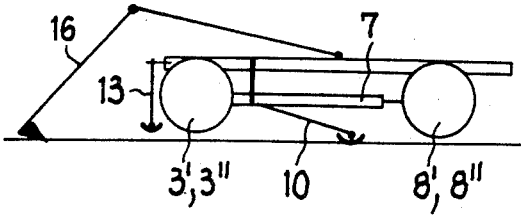
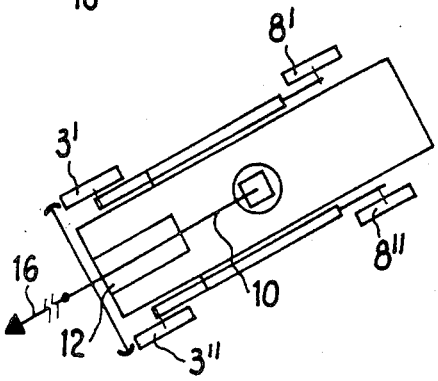
FIG. 17
FIG. 18
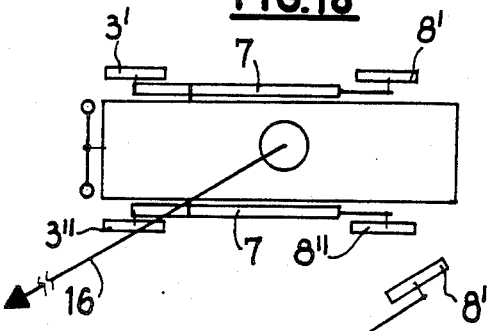
FIG. 19
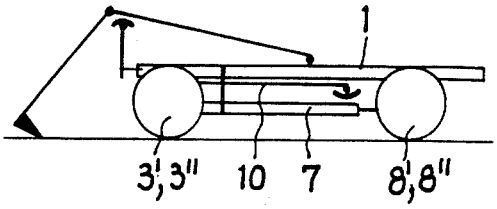
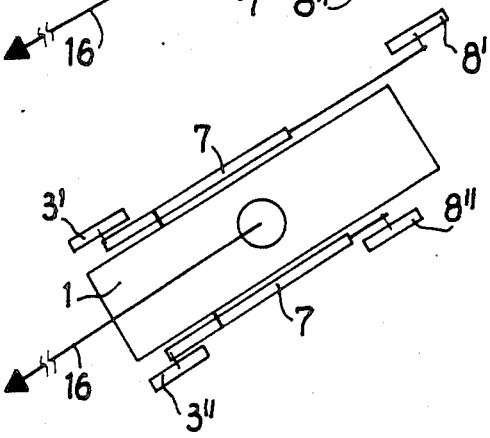
FIG. 20

EARTH DIGGING MACHINE FOR USE ON SOFT OR UNDULATING TERRAIN, PARTICULARLY FOR THE CLEARING OF PONDS, SWAMPS OR CANALS

BACKGROUND OF THE INVENTION

The invention concerns an earth digging machine for use on soft or highly undulating terrain, in particular for the clearing and dredging of ponds, swamps or canals.

There are numerous earth digging machines already in existence, such as machines on wheels and dredgers, designed for these type of operations. Machines on wheels have very limited possibilities owing to the risk of sinking. Dredgers can only operate on sheets of water having a sufficient depth, which is rarely the case with ponds, swamps or canals.

Equally, there exist civil engineering works machines fitted with two shovel dredgers mounted on each end of a load-bearing structure consisting of an impervious body having a bevelled section near the rear moving over the ground.

These machines can be used in good conditions for the clearing of ponds, swamps, canals or ditches, but unfortunately present the drawback of often requiring the presence of two operators.

SUMMARY OF THE INVENTION

The invention hereinafter described concerns a machine of the type just described and which enables effective work to be carried out safely and efficiently and with a single operator.

With this end in view, the invention concerns an earth digging machine for use on soft terrain, undulating or inclined, in particular for the clearing and dredging of ponds, swamps or canals, of a type comprising a load-bearing structure fitted with a central stabilizer and lateral stabilizers and equipped with at least one earth digging device such as a shovel, this device being controlled from a pilot cabin mounted on the load-bearing structure, characterized in that the central stabilizer is secured to a control carriage moving between two side rails of the load-bearing structure, at least two support devices such as wheels or walking legs being mounted on telescopic arms controlling the displacement of the devices.

According to an embodiment, the machine comprises four support devices such as wheels, two of which are telescopic, these four devices being fitted with individual lifting controls.

According to preferred features, hydraulic controls are provided for displacement of the carriage, for the telescopic arms and for elevation of the support devices.

BRIEF DESCRIPTION OF THE DRAWINGS

A machine according to the invention is represented, by way of example by no means restrictive, on the attached figures in which:

FIGS. 15 to 17 are diagrammatic views representing a first machine rotation possibility;

FIGS. 18 to 20 are diagrammatic views representing a second machine rotation possibility;

DESCRIPTION OF THE PREFERRED EMBODIMENTS

Figure 1:
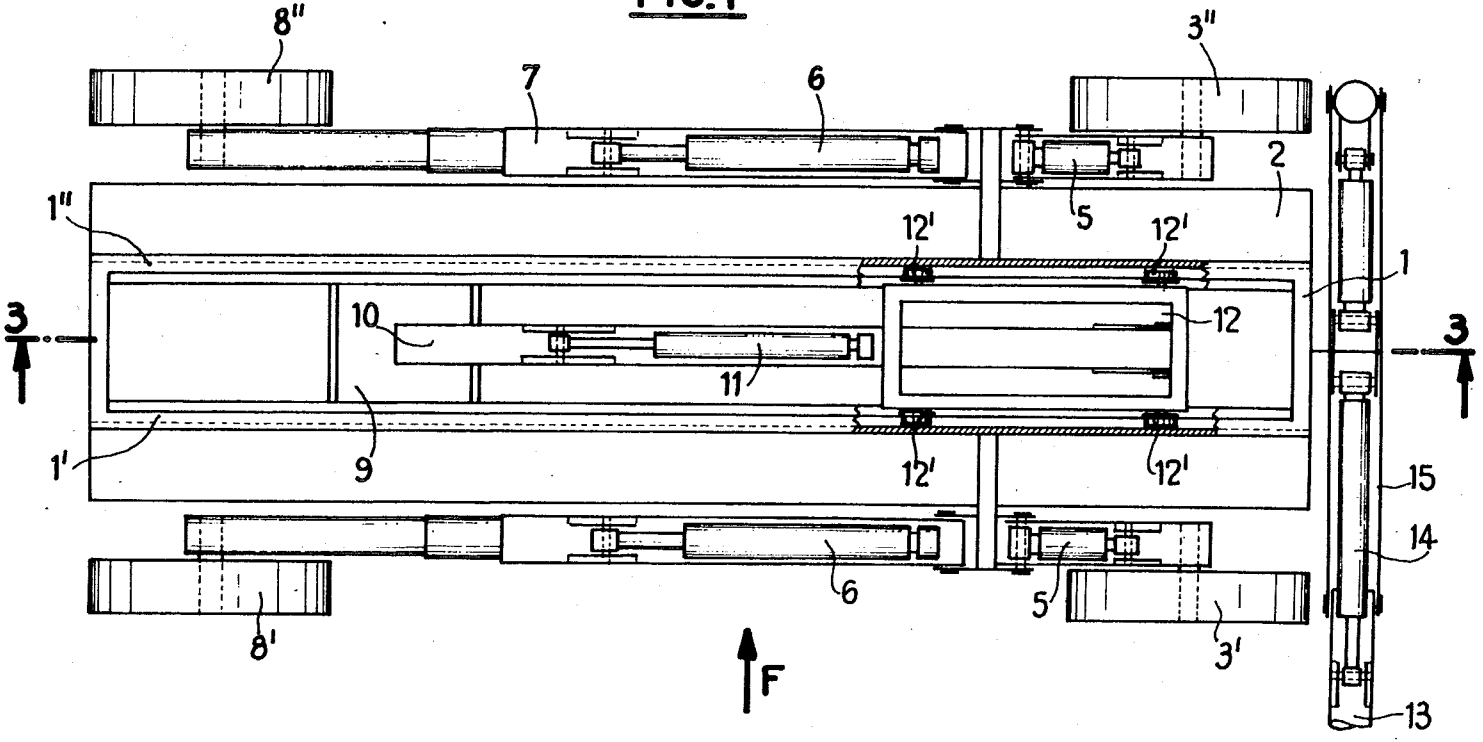
FIG. 1 is a plan view of the machine according to the invention after removal of the earth digging devices.
Figure 2:
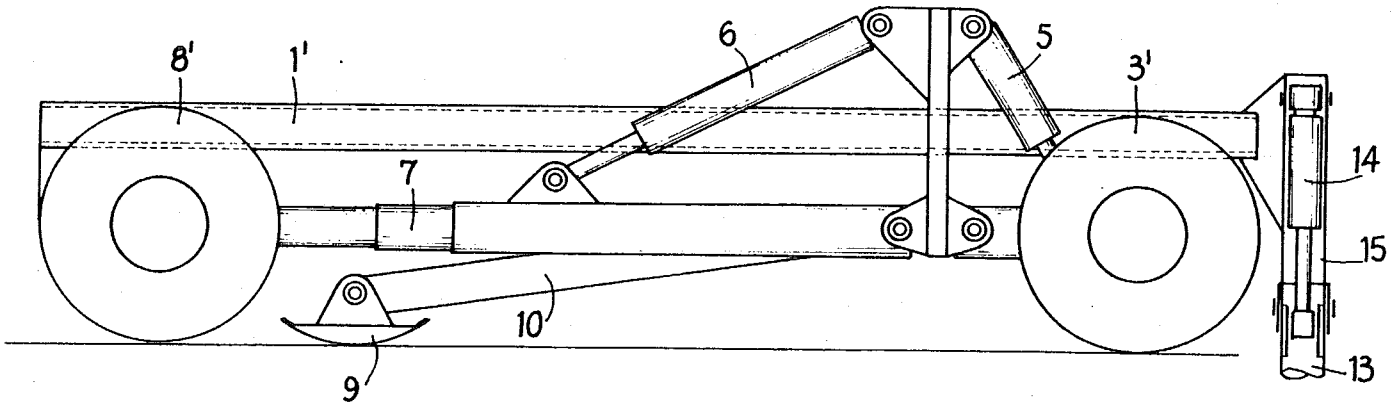
FIG. 2 is a front side view of the machine in the direction of the arrow F of FIG. 1.
Figure 3:
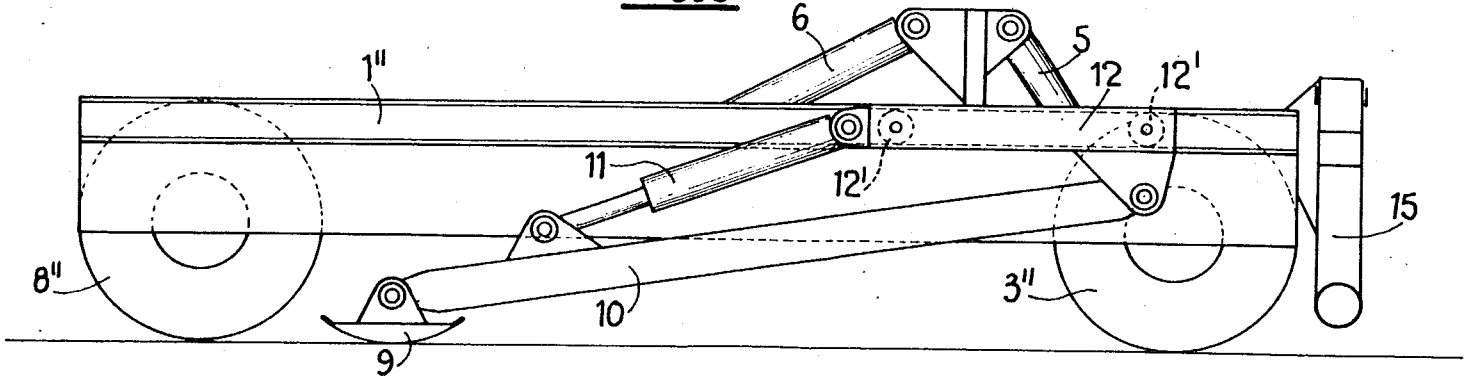
FIG. 3 is a longitudinal section view following the line 3—3 of FIG. 1.
Figure 4:
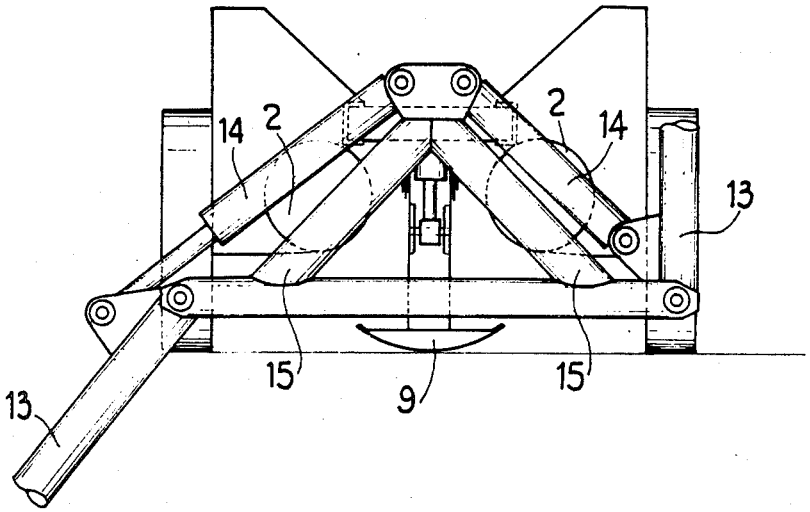
FIG. 4 is a front extremity view showing the lateral stabilizers.
Figure 5:
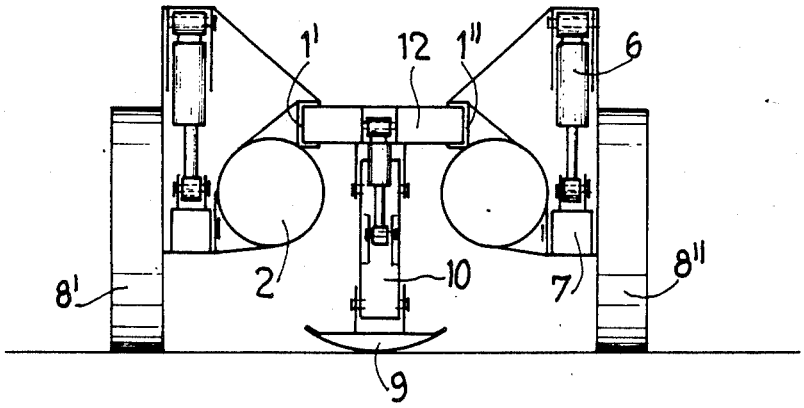
FIG. 5 is a transversal section view.
Figure 6:
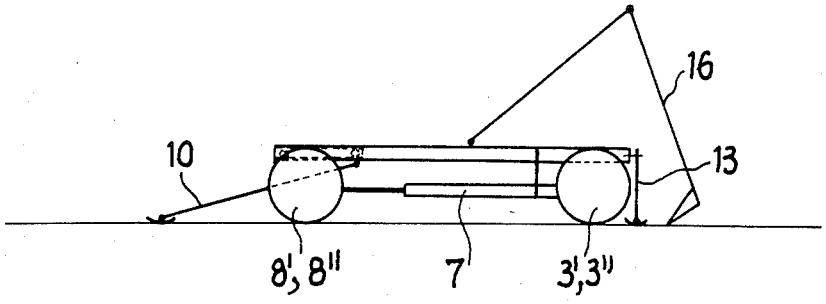
FIGS. 6 to 12 are diagrammatic lateral views representing a machine displacement stage.
Figure 7:
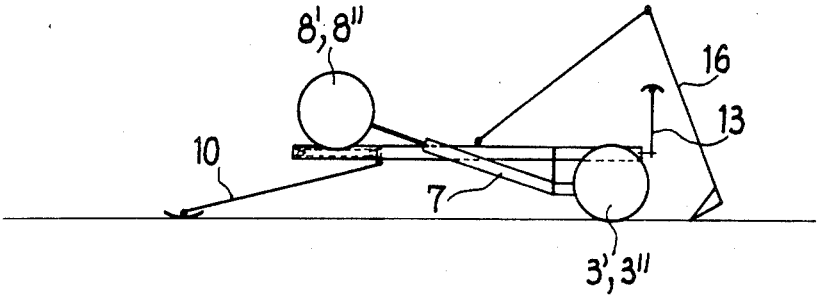

In the realization selected and illustrated on FIGS. 1 to 5, the machine is essentially made up of a load-bearing structure of frame 1 comprising two U-shaped sectional side rails 1', 1''. Floats 2 with reduced dimensions are mounted on the frame, for example by welding, so as to reinforce the structure and prevent it from buckling. The floats 2 act simply as reinforcement elements and are not dimensioned to provide the machine with buoyancy.

One or more earth digging devices, for example shovel dredgers, are assembled on the load-bearing structure. Such a device is diagrammatically represented on FIGS. 13 and 14. It can be of any suitable type whatsoever.

The machine rests on the ground on four support devices 3', 3'', 8', 8'' represented in the form of wheels, but which may also consist, for example, of walking support legs. The wheels 8', 8'' which, for the purposes of the description shall be regarded subsequently as front wheels, are mounted on the telescopic arms 7, preferably with hydraulic control. The four wheels 3', 3'', 8', 8'' are mounted so as to be able to be raised. In the realization example shown, the lift control of the wheels are provided by hydraulic jacks 5, 6. The wheels 8', 8'' are driving wheels and the wheels 3'', 3'' may be ordinary support wheels (non-driving wheels). However, it goes without saying that the said wheels 3', 3'' could also, if required, be coupled to the driving wheels 8', 8''.

The stability of the machine when operating is ensured by the stabilizers specially provided for this purpose. These devices include a central stabilizer 10 and two lateral stabilizers 13 mounted on the rear extremity of the machine. The central stabilizer 10 consists of an articulated arm fitted at its lower part with a shoe 9 resting on the ground. The arm of the central stabilizer 10 is integral with a carriage 12 moving by means of rollers 21' inside the side rails 1', 1'' of the load-bearing structure 1. The carriage 12 is preferably one with hydraulic control. The arm of the central stabilizer 10 can be raised and lowered by the hydraulic jack 11. The lateral stabilizers 13 are mounted on triangular supports 15, preferably tubular ones, and are controlled by the hydraulic jacks 14.

Figure 8:
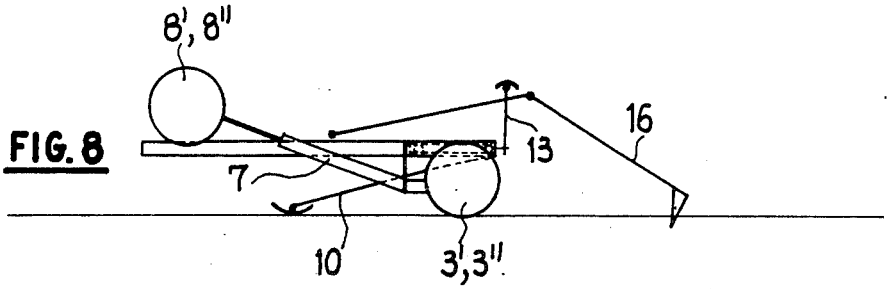
Figure 9:
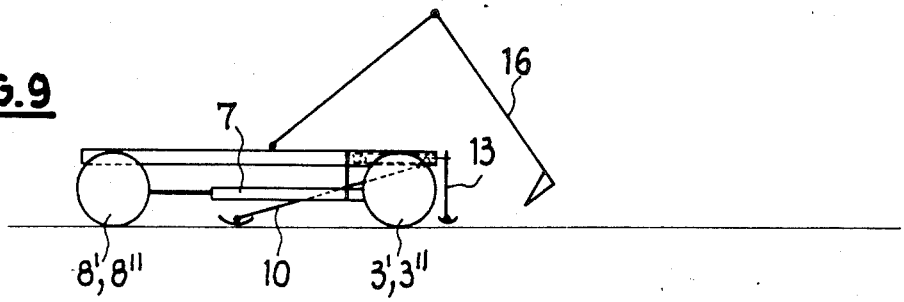
Figure 10:
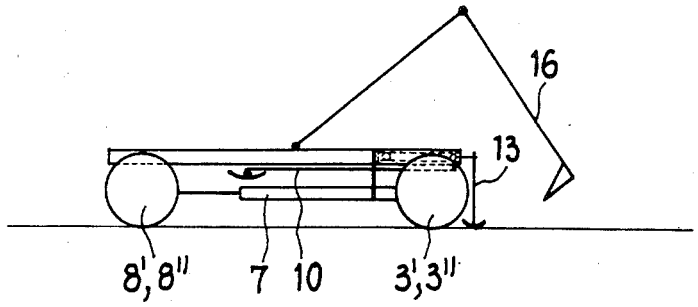
Figure 11:
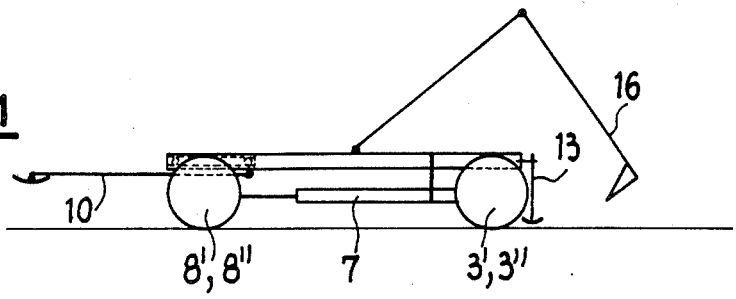
Figure 12:
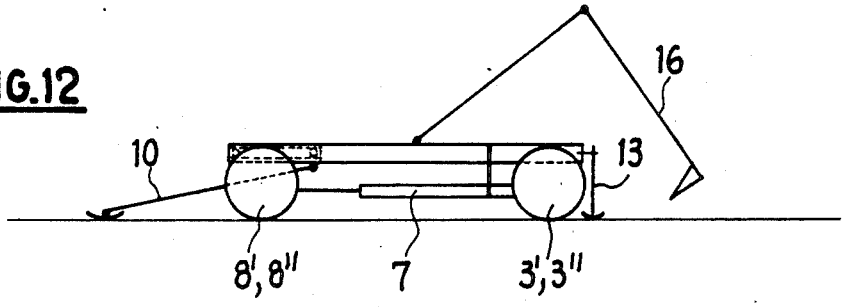

FIGS. 6 to 12 represent a displacement stage of the machine. According to FIG. 6, the machine rests on its wheels 3', 3'', 8', 8'' and on the central stabilizer 10 and lateral stabilizers 13. In accordance with FIG. 7, one begins by lifting the front wheels 8', 8'' and the lateral stabilizers 13. The load-bearing structure 1 of the machine is then displaced using the arm 16 of the shovel which takes support on the ground (FIG. 8). The carriage 12 and the central stabilizer 10 then rest in the position which they initially occupied. The front wheels 8', 8'' and the lateral stabilizers 13 are then brought back on the ground (FIG. 9). The central stabilizer 10 is then raised (FIG. 10). It is displaced with the carriage 12 in front of the machine (FIG. 11). Finally, the central stabilizer 10 is lowered (FIG. 12) and the machine reappears in a position similar to that of FIG. 6, by having advanced by one step.

FIGS. 15, 16 and 17 represent a first control possibility for turning the machine. The machine rests principally on the central stabilizer 10 constituting a first point of support and on the end of the arm 16 constituting a second point of support. The orientation control of the arm 16 is used to turn the bearing structure or frame 1 which comes into alignment with the arm. The wheels 3', 3'', 8', 8'' and the rear stabilizrs 13 are raised to a small extent (about 10 cm) so as to allow for movement, whilst being ready to intervene to maintain equilibrium of the machine.

FIGS. 18, 19 and 20 represent a second control possibility for turning the machine.

The telescopic arms 7 are first of all folded up and their wheels 8', 8'' are supported on the ground. The arm 16 of the shovel is positioned so as to correspond to the axis of the position which the chassis must attain. The rotation control of the arm is activated and the wheels 8' and 8'' are displaced as a result, the telescopic arm 7 of the wheel 8' being unfolded. The wheels 3' and 3'' are raised very slightly (about 10 cm) so as to be ready to maintain equilibrium and prevent the machine from jutting out.

Figure 13:
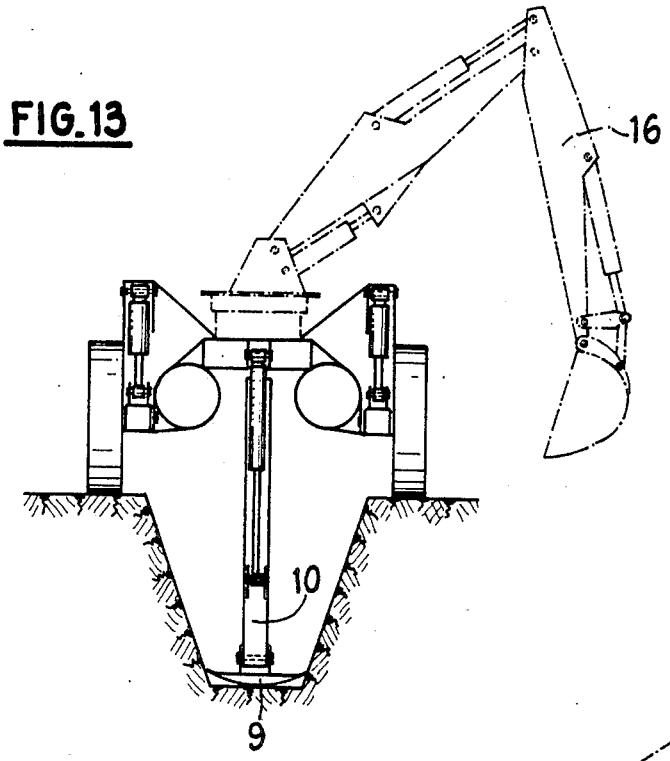
FIG. 13 is a diagrammatic extremity view representing the machine working on a ditch.

The engine according to the invention presents the advantage of being able to operate with a reduced capacity. FIG. 13 shows the machine operating over a ditch. The central stabilizer 10 can rest on its shoe 9 at the bottom of the ditch and forms a secure and resistant point of support. The machine can then operate close to the ditch without it being necessary to lay down a large track.

Figure 14:
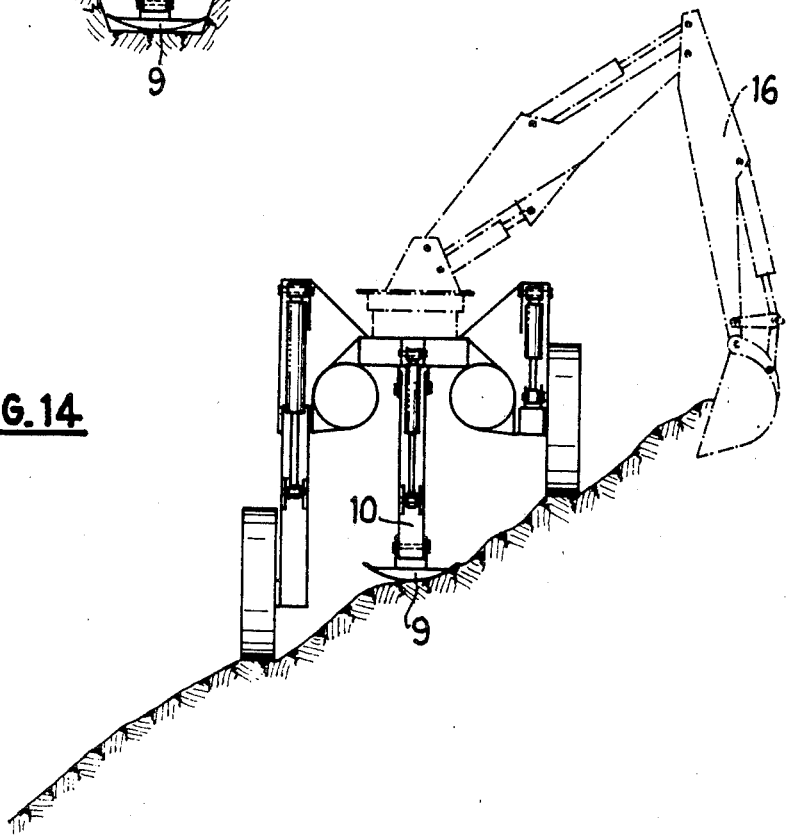
FIG. 14 is a diagrammatic extremity view showing the machine working on a slope.
Figure 21:
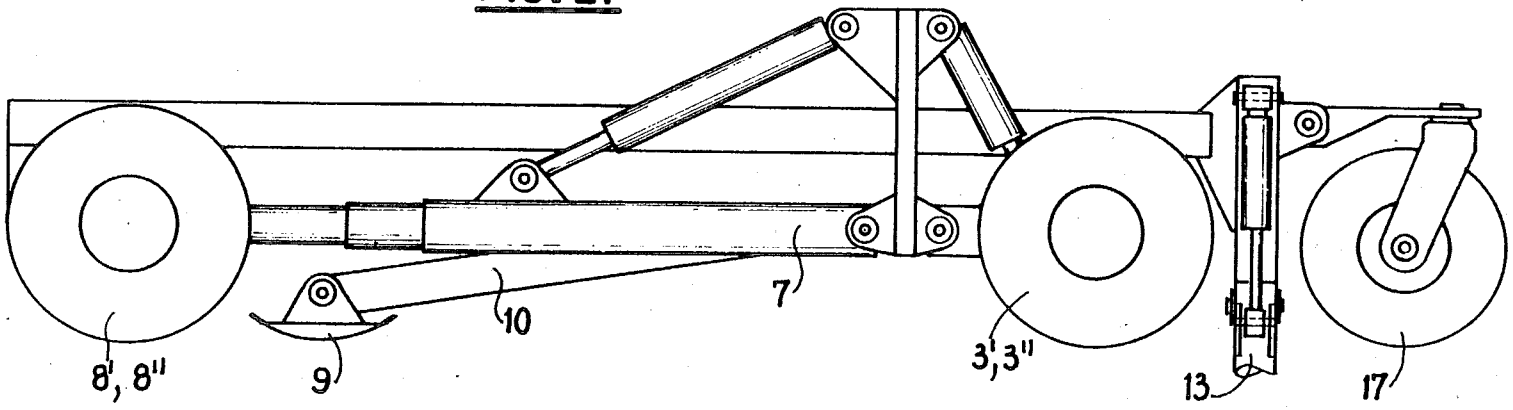
FIG. 21 is a front side view representing the machine equipped with a movable independent wheel.

As shown on FIG. 14, the machine can easily work on sloping terrain or highly undulating terrain strewn with obstacles. The lift controls of the wheels enable them to be disposed at the level required and the central stabilizer constitutes a further secure and resistant point of support assisted by the lateral stabilizers.

Figure 23:
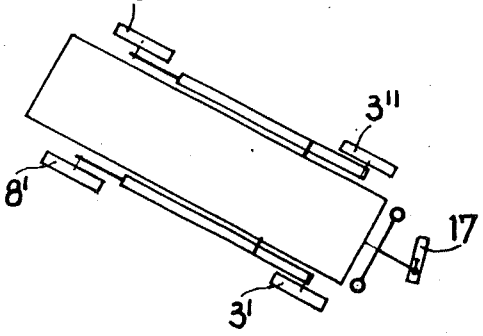
FIG. 23 is a view similar to FIG. 22 representing the rotation of the machine.
Figure 22:
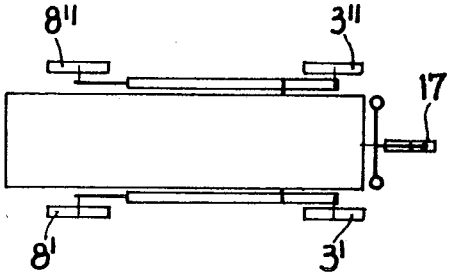
FIG. 22 is a diagrammatic view showing the displacement position on solid ground of the machine represented on FIG. 21.

The displacement onto solid ground is made using the two wheel-drive wheels 8', 8'' independent of each other. It is then necessary that the non wheel-drive wheels 3', 3'' and the lateral stabilizers be folded up. The machine is supported on the two wheel-drive wheels 8', 8'' and a loose wheel 17. In order to make the machine turn (FIG. 22 and FIG. 23), the wheel 8'' is stopped and the wheel 8' is made to turn. The rotation occurs around a spindle passing through this wheel and it is accompanied by the loose wheel 17. The machine can also be turned on the wheels 3', 8', 3'' and 8'' when these are all driving wheels.

Figure 24:
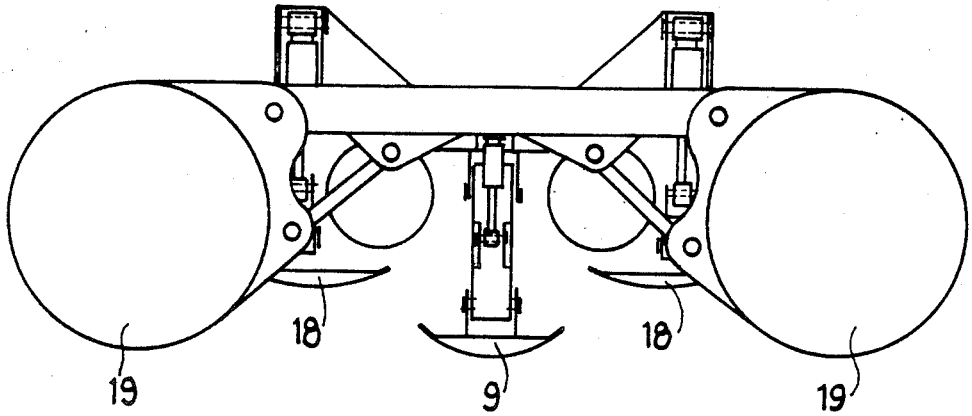
FIG. 24 is a transversal sectional drawing representing the machine equipped with floats ensuring its buoyancy.
Figure 25:
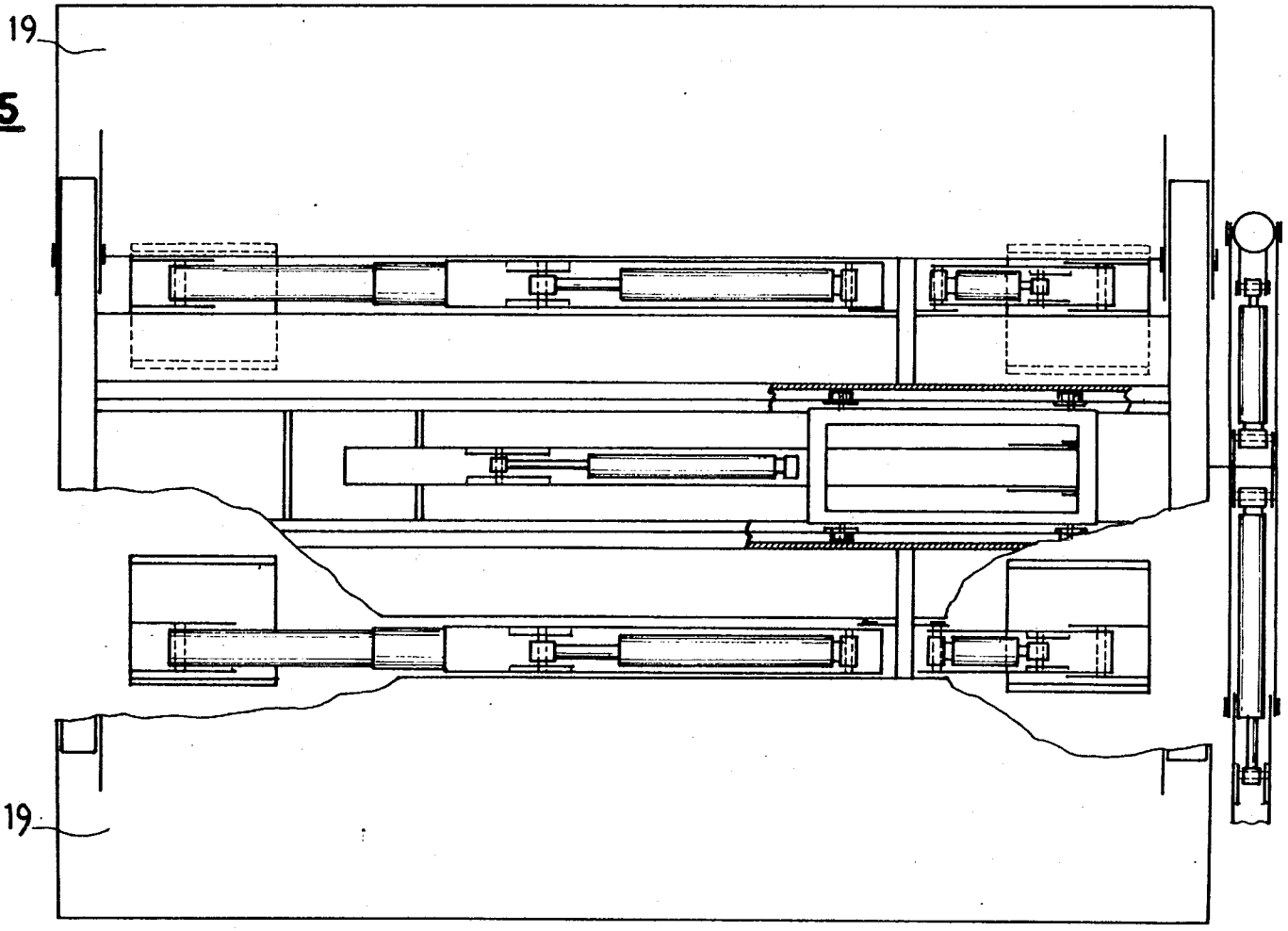
FIG. 25 is a plan view corresponding to FIG. 24.

FIGS. 24 and 25 represent a realization variant in which the machine is fitted with large floats 19 which enable it to move on sheets of water. In this case, at the time of assembling the floats 19, the wheels 8', 8'' must be replaced by shoes 18 and the stabilizers 13 must be lengthened.

Figure 26:
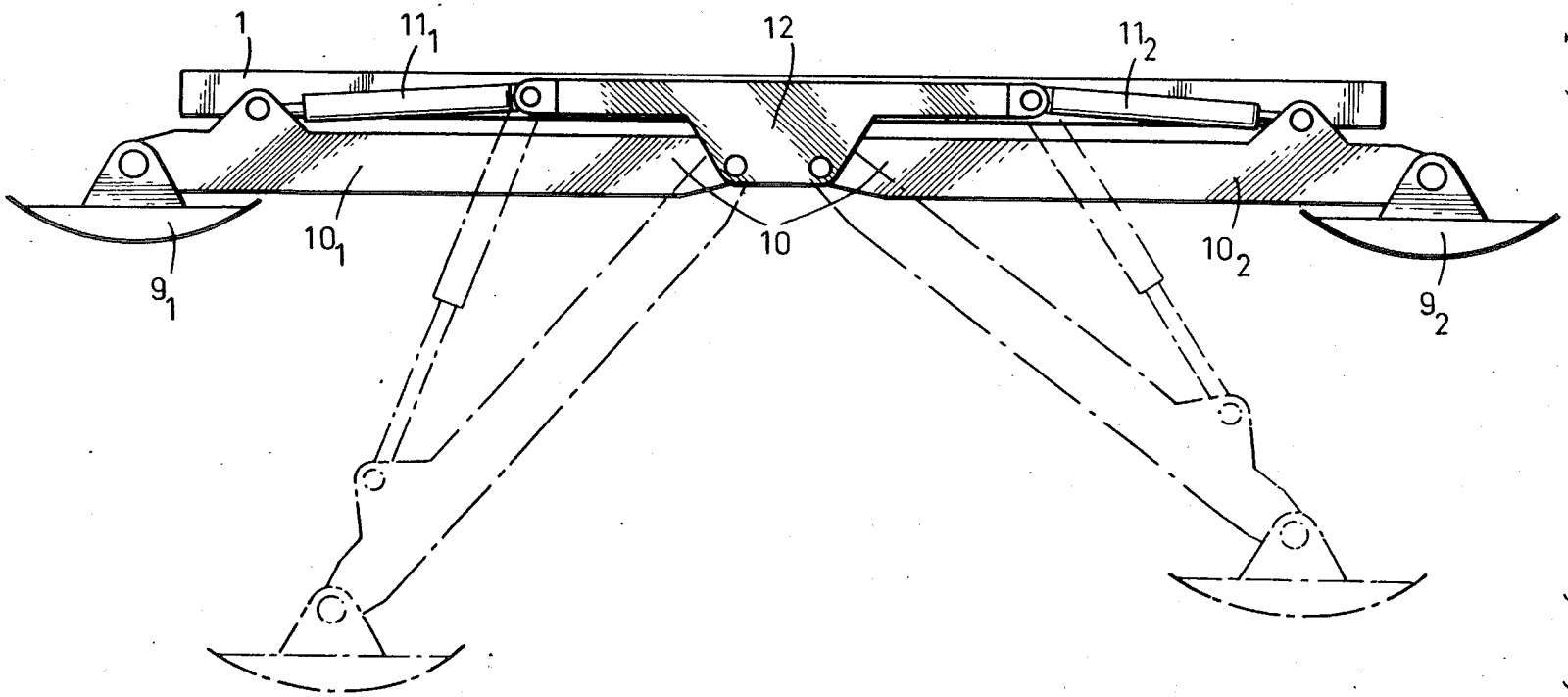
FIG. 26 is a lateral front view of a first realization variant example of the machine according to the invention.

When the machine is required to work on mixed soils (soft and firm), it may be advantageous to reinforce its stabilization without necessarily changing the frame. In such a case, as illustrated in FIG. 26, the central stabilizer 10 is coupled to the carriage 12 and consists of two elementary stabilizers $\mathbf{10_1}$, $\mathbf{10_2}$ which themselves consist of an arm fitted at its lower part with a saddle 91, 92 resting on the ground. The arms $\mathbf{10_1}$, $\mathbf{10_2}$ are activated by hydraulic control jacks $\mathbf{11_1}$, $\mathbf{11_2}$. The figure represents in a continuous line the elementary stabilizers in the folded up position. Their position by which they bear on the ground is shown by a dot and dash line.

Figure 27:
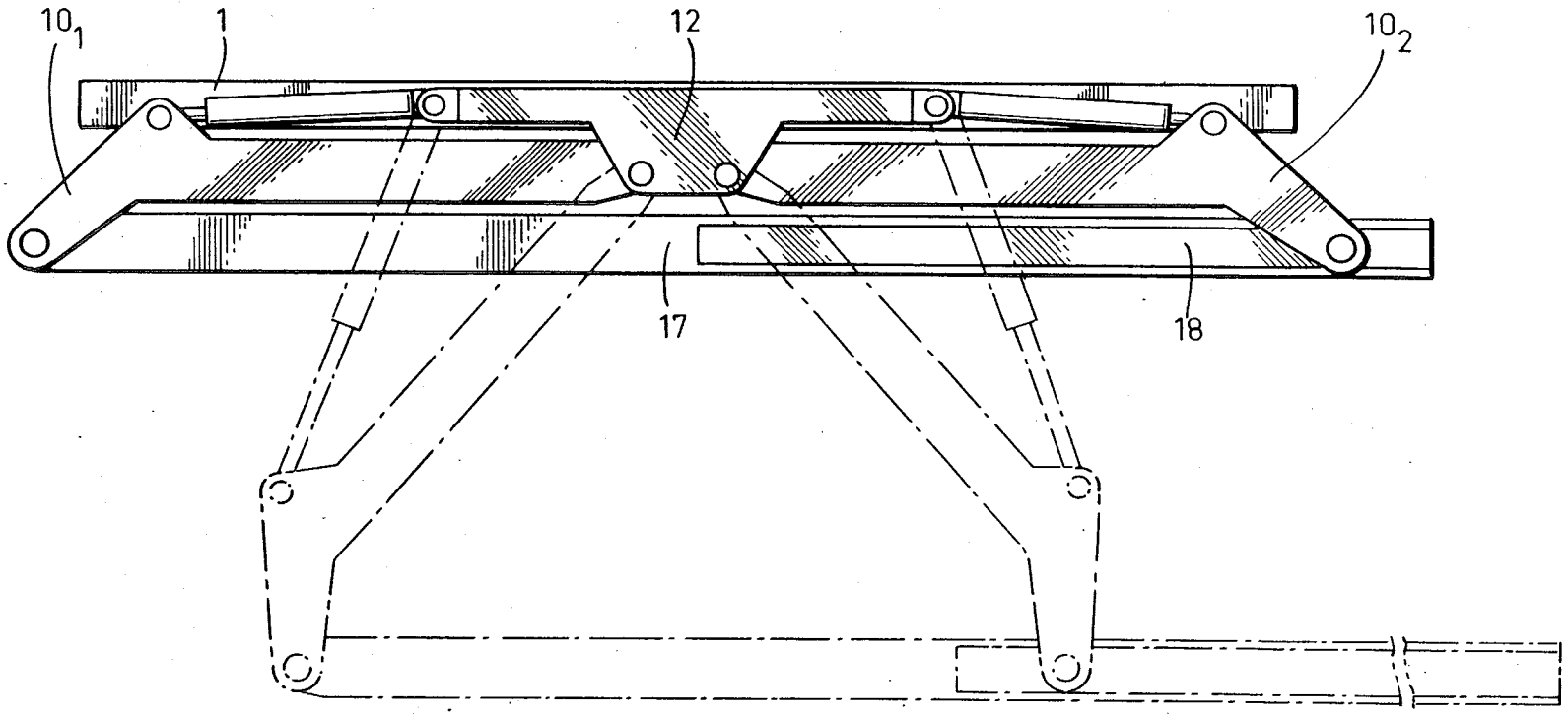
FIG. 27 is a view similar to FIG. 26 representing a second realization variant example of the machine according to the invention.

FIG. 27 represents another example for realizing the invention in which the elementary central stabilizer $\mathbf{10_1}$ is connected by articulation to an elongated central element 20 forming a hollow caisson. Inside this central caisson 20 moves a slider 21 linked by articulation to the other elementary central stabilizer $\mathbf{10_2}$. As previously, the elementary stabilizers are represented by a continous line in their folded up position and by a dot-and-dash line in their support position on the ground.

In the realization example represented on FIG. 26, the machine can easily be displaced, whilst being supported on the shoes $\mathbf{9_1}$ and $\mathbf{9_2}$ on relatively hard or undulating soils, for example in mountainous regions, over steep banks and all obstacles to be scaled during operational works. The machine equipped in this way can advance without the jib of an earth digging device needing to be used.

The central caisson provided in the realization example represented in FIG. 27 enables the machine to move on ground with a low load-bearing capacity, especially ponds, canals, rivers, ports, etc. The surface of the caisson only allows the support base to be lightly stressed. The caisson thus avoids disturbing the bottom and prevents piercing of the impervious bed which often plays an important role.

These advantages are obtained in all cases without changing the load-bearing structure of the machine. It is sufficient to provide two articulations on the carriage 12. The floats which reinforce the structure retain their functions and can, if the works to be executed so require, be dimensioned so as to provide the machine with total buoyancy.

In certain cases, with the central stabilizer according to the realization mode of FIGS. 26 and 27, the lateral stabilizers can be dispensed with.

I claim:

1. In a soft terrain earth digging machine vehicle, especially useful for clearing and dredging ponds, swamps, canals and the like, and having a frame with four wheels attached to and supporting said frame on ground and defining a nominal wheelbase, and an automated shovel pivotally attached to said frame by a boom, the improvement comprising:

means, operatively associated with at least one pair of said wheels, for raising said one pair of said wheels from the ground;

a carriage attached for relative movement along a length of said frame, said carriage having a central stabilizer arm and means for engaging said arm with and disengaging said arm from the ground and said arm being sufficient with another pair of wheels, when said one pair of wheels are raised and said arm is engaged with the ground, to provide three point stable support of said vehicle on said ground; and means, operatively associated with said carriage, boom and shovel, for actuating said carriage, boom and shovel are operable along with said wheel raising means so as to propel said vehicle, wherein said frame is supportable, alternately on said four wheels and on said three point support, and is shiftable relative to said carriage by engaging said shovel with said ground and moving said boom to propel said vehicle by moving said frame relative to said carriage, when supported by said three point support, on said other pair of wheels while said central stabilizer arm and carriage remain stationary relative to said ground.

2. An improvement as in claim 1, and further comprising:

telescopic supports interconnecting said wheel raising means and corresponding wheels and being individually actuatable by telescopic support actuators in order to lengthen said nominal wheel base for said machine vehicle.

3. An improvement as in claim 1, and further comprising:

lateral stabilizers attached to said frame and disposed generally outside of said nominal wheel base.

4. An improvement as in claim 1, and further comprising:

said central stabilizer arm being of sufficient length and said carriage being sufficiently shiftable relative to said frame such that a free end of said central stabilizer is positionable outside of said nominal wheel base.

5. An earth digging machine vehicle according to claim 1, and further comprising:

a loose wheel and means for attaching said loose wheel to said frame so that said attaching means is pivotal about a generally vertical axis, such that said loose wheel and said other pair of wheels are sufficient to provide three point stable support of said vehicle on the ground and allow turning of said vehicle while driving only one of said other pair of wheels.

6. An earth digging machine vehicle according to claim 1, and further comprising:

floats of sufficient size to ensure buoyancy of said vehicle.

7. An earth digging machine vehicle according to claim 1 and further comprising:

another central stabilizer arm of the carriage, said other central stabilizer arm being operable by said engaging and disengaging means such that said three point support becomes four point support upon engagement of both said central stabilizer arms with the ground.

8. An earth digging machine vehicle according to claim 7, characterized in that each central stabilizer arm is articulated on the carriage.

9. An earth digging machine vehicle according to claim 7, characterized in that each central stabilizer arm comprises, at a free end thereof, a ground engaging support block.

10. An earth digging machine vehicle according to claim 7, characterized in that one of the central stabililzer arms is linked by articulation to a central caisson cooperatively coupled with a slider moveably linked by articulation to the other central stabilizer arm, such that an extensible line of support is provided between said stabilizer arms.

11. An earth digging machine vehicle according to claim 7, characterized in that said engaging and disengaging means comprises a hydraulic jack for each central stabilizer arm.

* * * * *